US006011492A

United States Patent [19]

Garesché

[11] Patent Number: 6,011,492

[45] Date of Patent: Jan. 4, 2000

[54] VEHICLE WARNING SYSTEM FOR VISUAL COMMUNICATION OF HAZARDOUS TRAFFIC CONDITIONS

[76] Inventor: Carl E. Garesché, 920 Holbron Rd., Streetsboro, Ohio 44241

[21] Appl. No.: 09/108,129

[22] Filed: Jun. 30, 1998

[51] Int. Cl.[7] ..... G08G 1/00

[52] U.S. Cl. ..... 340/904; 340/901; 340/902; 340/825.71

[58] Field of Search ..... 340/902, 901, 340/903, 904, 539, 502, 961, 435, 436, 825.71, 825.72; 455/45, 34.1, 34.2

[56] References Cited

U.S. PATENT DOCUMENTS

| | | | |
|---|---|---|---|
| 3,412,378 | 11/1968 | Thomas | 340/34 |
| 3,568,144 | 3/1971 | Streb | 340/34 |
| 3,859,623 | 1/1975 | Koehler | 340/34 |
| 4,158,190 | 6/1979 | Stefanov | 340/34 |
| 4,209,769 | 6/1980 | Chronerberry | 340/34 |
| 4,380,004 | 4/1983 | Coats | 340/34 |
| 4,587,522 | 5/1986 | Warren | 340/902 |
| 4,706,086 | 11/1987 | Panizza | 340/902 |
| 4,759,069 | 7/1988 | Bernstein | 381/56 |
| 4,785,474 | 11/1988 | Bernstein | 381/56 |
| 4,794,394 | 12/1988 | Halstead | 340/902 |
| 5,126,735 | 6/1992 | Trevijano | 340/902 |
| 5,235,329 | 8/1993 | Jackson | 340/902 |
| 5,278,553 | 1/1994 | Cornett | 340/902 |
| 5,287,411 | 2/1994 | Hill | 381/36 |
| 5,289,181 | 2/1994 | Watanabe | 340/902 |
| 5,307,060 | 4/1994 | Prevulsky | 340/902 |
| 5,495,242 | 2/1996 | Kick | 340/902 |
| 5,495,243 | 2/1996 | McKenna | 340/902 |
| 5,559,508 | 9/1996 | Orr et al. | 340/902 |
| 5,572,201 | 11/1996 | Graham et al. | 340/902 |
| 5,629,689 | 5/1997 | Curwood | 340/902 |
| 5,739,767 | 4/1998 | Carr | 340/902 |
| 5,757,284 | 5/1998 | Trizzino et al. | 340/902 |
| 5,805,103 | 9/1998 | Doi et al. | 342/70 |
| 5,808,560 | 9/1998 | Mulanax | 340/902 |

*Primary Examiner*—Jeffery A. Hofsass
*Assistant Examiner*—Toan Pham

[57] ABSTRACT

A vehicle warning system consisting of a transceiver that augments the audible warnings of standard or emergency vehicles by transmitting and receiving a signal (in conjunction with activation of the typical audible warnings; e.g., horns and/or sirens) which, when received, triggers a visual stimulus to alert drivers to the hazardous condition within the vicinity of their vehicle.

20 Claims, 5 Drawing Sheets

Carl E. Garesche
Sheet 1 of 5

FIGURE 1

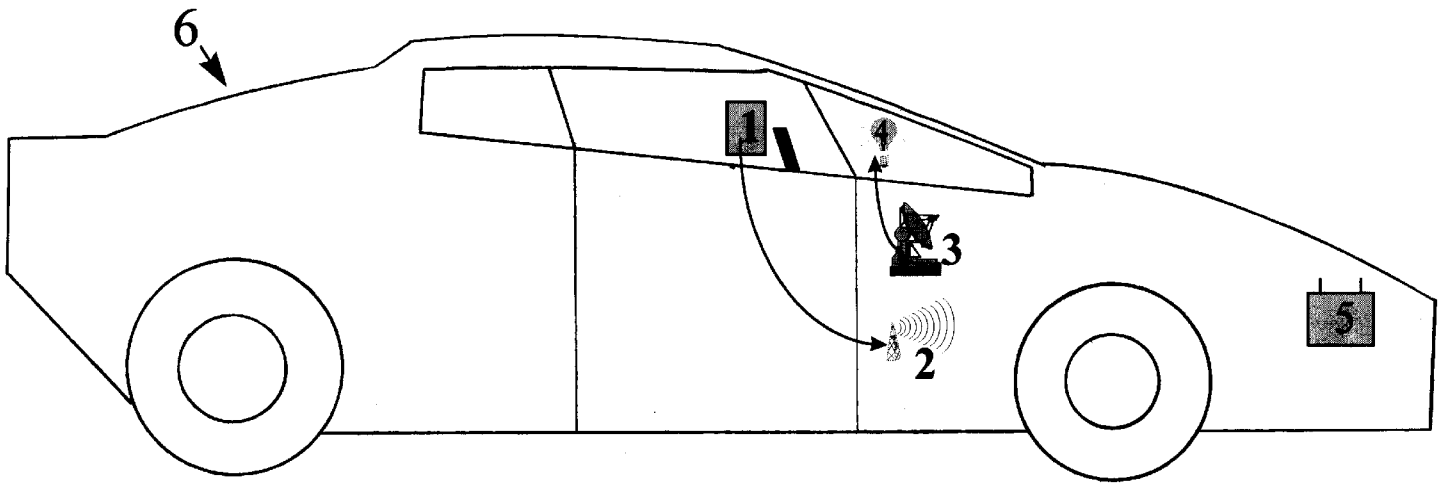

1 = vehicle horn and/or siren
2 = transmitter
3 = receiver
4 = warning light(s)
5 = vehicle battery
6 = vehicle (standard or emergency)

Vehicle battery (5) powers all components. Vehicle horn and/or siren/flashers (1) trigger transmitter (2) which sends out signal. All receivers (3) in vicinity pick up transmitter's (2) signal and, in turn, trigger warning lights (4).

Vehicle Warning System for Visual Communication of Hazardous Traffic Conditions

G980607

Carl E. Garesche
Sheet 2 of 5

Vehicle Warning System for Visual Communication of Hazardous Traffic Conditions

G980607

Carl E. Garesche
Sheet 3 of 5
Figure 3
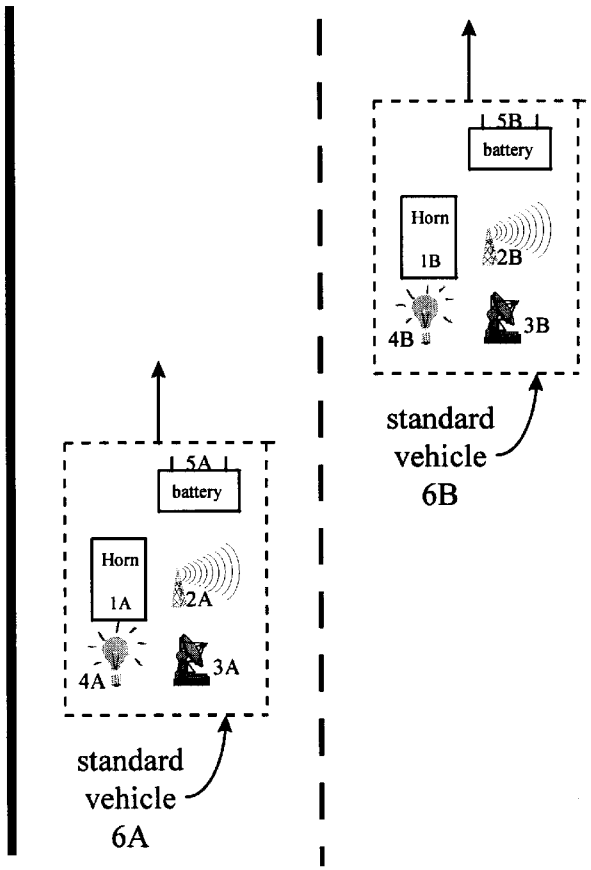
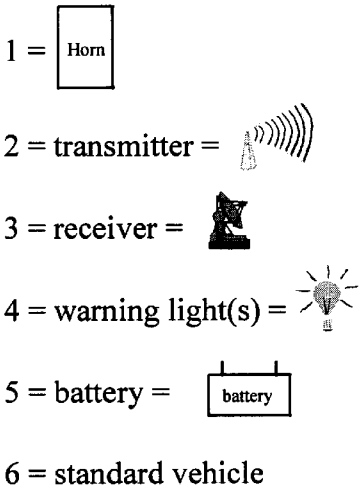
Vehicle Warning System for Visual Communication of Hazardous Traffic Conditions
G970607

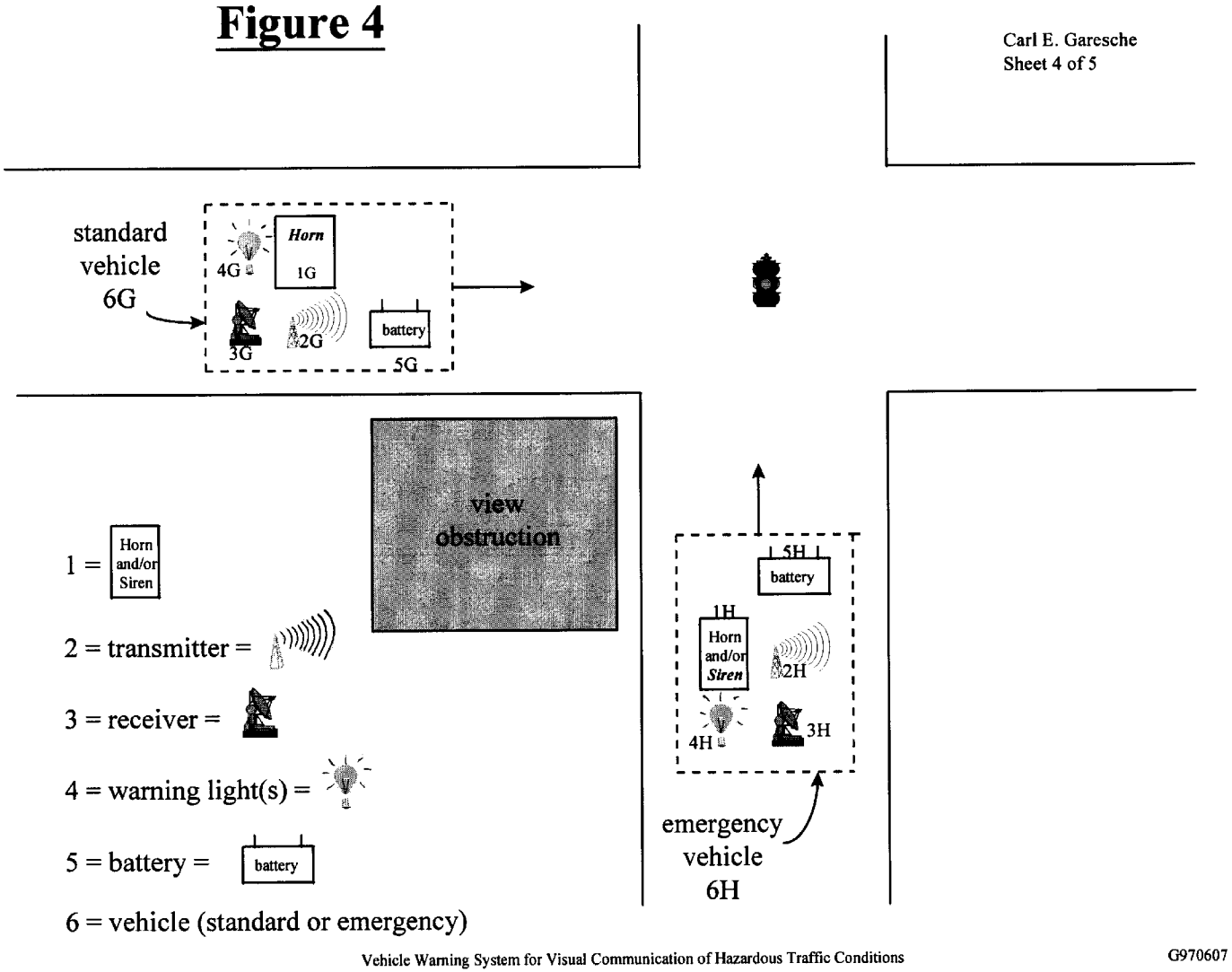
Vehicle Warning System for Visual Communication of Hazardous Traffic Conditions Carl E. Garesche
Sheet 5 of 5

11 = horn
12 = transmitter
12A = contact pad A for transmitter
12B = contact pad B for transmitter
13 = receiver
14 = warning light
15 (A&B) = batteries
17 = dashboard
18 = windshield
19 = steering wheel
20 = steering column

Figure 5A

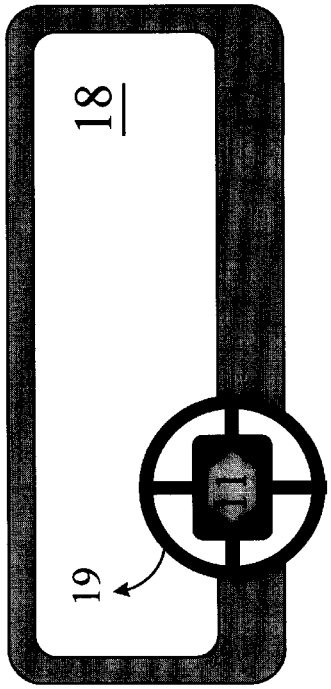

Vehicle X without apparatus

Figure 5B

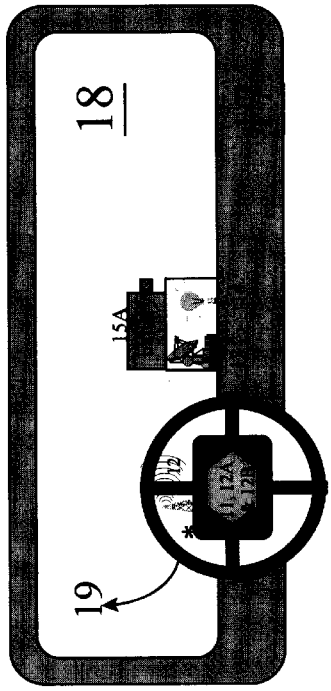

Vehicle Y with apparatus (* battery 15B not depicted here due to size constraints)

Figure 5C

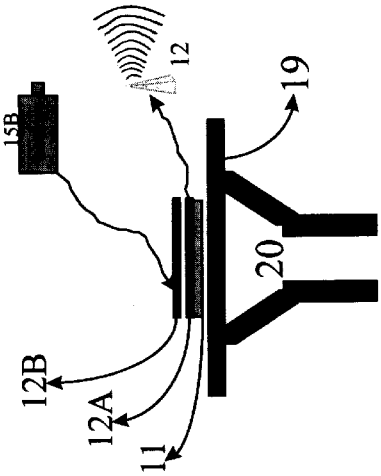

Vehicle Warning System for Visual Communication of Hazardous Traffic Conditions

G970607

VEHICLE WARNING SYSTEM FOR VISUAL COMMUNICATION OF HAZARDOUS TRAFFIC CONDITIONS

BACKGROUND

1. Field of Invention

This invention relates generally to automobiles and emergency vehicles and particularly to alarm and warning systems used therein.

2. Description of Prior Art

There are currently many different methods for communication between automobile drivers in traffic. Most methods involve the sense of eyesight (e.g., with turn signals, brake lights, etc.). The prevalent method of communicating impending danger, however, is via the sense of hearing (e.g., with horns or sirens). Unfortunately, the driver's ability to hear these warnings may often be impaired.

The concept is to overcome the current problem of drivers not being able to hear traffic warnings (horns and sirens) because automobile design is intent on limiting the driver's exposure to noise external to the vehicle, and/or because of competing noises such as stereo music, loud conversation, children crying, etc. Drivers may be afflicted with varying degrees of hearing impairment; some individuals may actually be partially/totally deaf, whereas others may have perfect hearing that is temporarily impaired due to competing noise. Regardless of the causes of hearing impairment, when considering the driver's ability to hear traffic warnings, any hearing impairment is further exacerbated by the current philosophy of automobile design which places a premium on reducing the transfer of outside noises to the passenger compartment of vehicles. It is virtually impossible to hear horns or sirens if you are driving with your windows up and stereo on. The present invention will augment audible warnings with a visual stimulus, thus increasing the time a driver has to react to a dangerous situation, and decreasing the potential for accidents.

Prior art is littered with remotely related attempts. To date, none have been successfully implemented; thus, there is not an existing solution to this obvious problem. Patents which have been reviewed and appear to be related are: U.S. Pat. Nos. 3,873,963; 3,412,378; 4,158,190; 4,587,522; 4,380,004; 4,209,769; 3,859,623; 3,568,144; 4,706,086; 4,759,069; 4,785,474; 4,794,394; 5,126,735; 5,235,329; 5,278,553; 5,287,411; 5,289,181; 5,307,060; 5,495,242, 5,495,243; 5,559,508, 5,572,201; 5,629,689; 5,739,767; 5,757,284; 5,805,103, 5,808,560.

Virtually all of the prior art attempts have utilized sophisticated electronic circuitry to attempt to "recognize" the existence of a wailing siren. These devices are not only expensive to manufacture, but are limited in functionality due to the potential for environmental factors to negatively impact performance, as well as the sheer existence of a multitude of siren types; with fluctuating frequencies, amplitudes and sound intensities. These prior art devices would also be difficult to periodically test to ensure continuing operational functionality. One would need to simulate a siren, or numerous sirens, to ensure that the device continues to work properly. This would be a nuisance to the installer, as well as the vehicle operator. Another limitation of the prior art is simply that it focuses solely on the warnings produced by emergency vehicles, and ignores the warnings produced by the standard automobiles driven everyday by the general public. In other words, with all of the prior art, standard (non-emergency) vehicles are only equipped with a form of receiver, and are not equipped to transmit a similar "style" warning to other vehicles in the vicinity.

OBJECTS AND ADVANTAGES

Accordingly, several objects and advantages of my invention are scope, cost, reliability and overall simplicity. Every prior art patent that addresses this issue focuses solely on the problem associated with receiving the warnings of emergency vehicles and their sirens and providing a resulting visual stimulus to drivers in the vicinity. This invention will primarily address transmitting and receiving warnings in conjunction with the utilization of a vehicle's horn (even the horns of emergency vehicles) and providing a resulting visual stimulus to drivers in the vicinity, and will address sirens as a mere extension of the concept. From a cost standpoint, prior art typically utilizes sophisticated electronics to discern the presence of wailing sirens. The present invention utilizes simple transmitter/receiver electronics, analogous to those of garage door openers, but modified/enhanced to "fit" the present application.

From a reliability standpoint, the current invention is a closed loop system that will be much more functionally immune to environmental influences than prior art sensors, and has the reliability that accompanies years of transmitter/receiver experience. This "pitch and catch" approach yields dependable operation and low manufacturing costs. The preferred embodiment utilizes a shared/common form of communication, thus avoiding the complexity associated with too many "bells and whistles" (a pitfall that probably has led to the failure of the prior art).

In order to evaluate whether or not the device is working properly, one merely needs to sound their horn and see if the warning light(s) is activated. This is a distinct advantage inasmuch as the installer can quickly ensure proper installation; the driver/owner can easily ascertain continued functionality of the apparatus; and a vehicle inspector could check off this potential item with only a few seconds worth of effort. With prior art, you would need to simulate a siren to determine if the device was working properly. Additionally, the range of the present device is limited to the distance necessary to accommodate typical human reaction time. The failed prior art rarely addresses this aspect, and could prove to be a nuisance if the coverage was too great.

Further objects and advantages of my invention will become apparent from a consideration of the drawings and ensuing description.

DRAWING FIGURES

In the drawings, letter designations are used to identify similar components in different vehicles or similar components within a vehicle.

FIG. 1 shows a vehicle with the various components of one embodiment of the present invention.

FIG. 3 depicts a working example of the present invention where one standard vehicle warns another of a potential hazardous driving situation.

FIG. 4 depicts another working example of the present invention where an emergency vehicle warns a standard vehicle of a potential hazardous driving situation.

Figure 2:
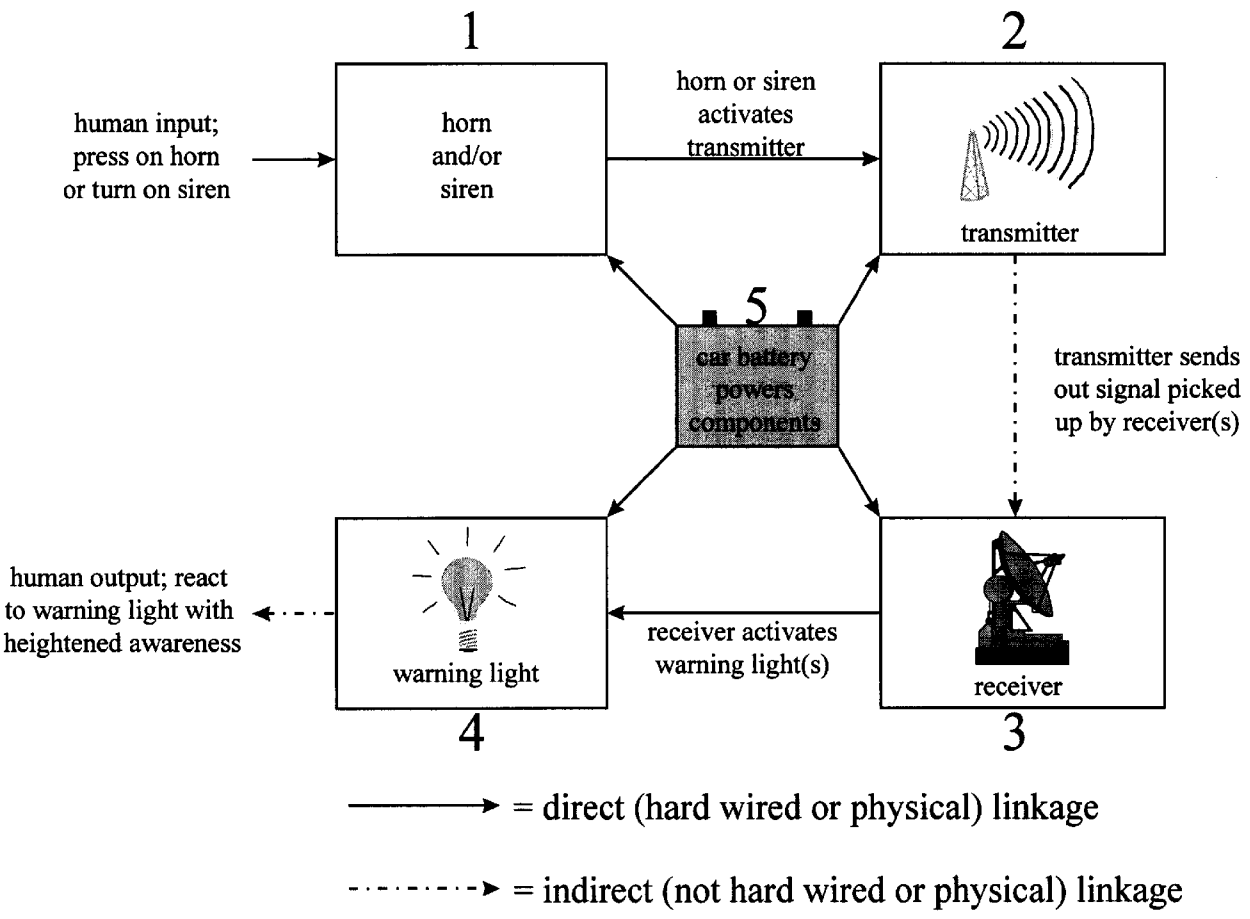
FIG. 2 shows a block diagram/schematic of the various components of one embodiment of the present invention.

FIGS. 5A, 5B and 5C collectively show one alternate embodiment that utilizes independent battery sources to power the components of the present invention plus an alternate form of linkage to a standard vehicle horn.

REFERENCE NUMERALS IN DRAWINGS

Vehicle Horn and/or Siren

2 Transmitter

3 Receiver
4 Warning Light(s)
5 Vehicle Battery
6 Vehicle (Standard or Emergency)
11 Horn
12 Transmitter
12A Contact Pad "A" for Transmitter Activation
12B Contact Pad "B" for Transmitter Activation
13 Receiver
14 Warning Light(s)
15 Batteries
17 Dashboard
18 Windshield
19 Steering Wheel
20 Steering Column

SUMMARY

The present invention is a transceiver device used to augment the audible warnings of standard or emergency vehicles by transmitting and receiving a signal (in conjunction with activation of the audible warnings) which, when received, triggers a visual stimulus to alert drivers to the hazardous condition within the vicinity of their vehicle.

DESCRIPTION OF A PREFERRED EMBODIMENT—FIGS. 1 & 2

A preferred embodiment of the invention utilizes certain existing vehicle systems in conjunction with the electronic components of the invention itself (reference FIG. 1). Existing vehicle systems are the battery as a power source (#5), horns and/or sirens (#1) as catalyst for a transmitter (#2), and passenger compartment lights (#4) for visual warning, e.g., a light source that is inherent to the present invention or possibly existing dashboard warning lights, dome lights, map lights, or others tied in to a receiver (#3). The electronic components of this preferred embodiment consist of a transmitter (#2), a receiver (#3), and connections (wire, etc.) between all of the aforementioned constituents. Note that for new vehicle manufacture one could tie the receiver into a new dashboard warning light of sufficient size and location for the intended use.

It is intended that at least five versions of the actual device be covered under the scope of this patent application. The devices will be slightly different whether used on standard vehicles (cars, automobiles, trucks, etc.) or emergency vehicles (police, fire, ambulance, etc.) and will also differ slightly whether they are to be installed on existing vehicles (retrofit), or new production. The specific example of a preferred embodiment described herein will delineate a form of the device to be used in retrofitting standard vehicles (i.e., non-emergency vehicles). It is anticipated that anyone skilled in the art could successfully extend the application of the invention to any of the potential versions, or combinations thereof First, it is helpful to look at the analogous operation of the typical garage door opener: A. You press a button on a remote transmitter that is powered by a battery; B. it transmits a signal to a receiver attached to the garage door and powered typically by home electricity; C. the receiver picks up the signal and activates the garage door opener (and usually a light) typically powered by home electricity. In this embodiment of the invention, all components are powered by the automobile's battery (reference FIG. 2, #5). Pressing on your horn not only sounds the horn, but also energizes the transmitter (step A above, and FIG. 2, #1 & #2); the transmitter sends out a signal to all receivers in the immediate vicinity (step B above, and FIG. 2, #2 & #3); all receivers in the vicinity pick up the signal, including your own, and activate one or more warning lights in the respective passenger compartment—e.g., a light source that is inherent to the present invention or possibly existing dashboard warning lights such as, "engine", "door ajar", "oil low", "low coolant", etc. (step C above, and FIG. 2, #3 & #4)

The difference with garage door openers is primarily twofold. First, all of the receivers and transmitters associated with the present invention are tuned to the same frequency (and/or are encrypted with the same digital/binary code) in order to communicate universally (and/or exclusively) with one another. By necessity, garage door openers do not communicate universally (so that one transmitter does not open every garage door in the neighborhood). Second, the transmitter/receiver combination (transceiver) of the present invention will be active for as long as the input is in existence (as opposed to the garage door opener that works on an impulse basis that toggles between opening and closing the garage door). In other words, for as long as someone is "laying" on their horn, or a siren is wailing in your immediate vicinity, your warning lights will be active. Conversely, if someone just sounds their horn twice to try and make you aware of their presence, your warning lights will flash twice in concert with the use of their horn. Another potential distinction between antiquated garage door opener transmitters/receivers is that the present invention will make use of some state-of-the-art electronics (e.g., surface mounted technologies, binary or digital encryption/coding to individualize the carrier frequency, etc.). Furthermore, the actual frequency at which the invention communicates could also be much removed from frequencies used for garage door openers today in the United States.

Summarizing operation with reference to FIG. 2: A dangerous situation arises while driving; the driver presses on his/her horn (#1) the horn simultaneously activates both the audible noise and the transmitter of the present invention (#2); the transmitter sends out a signal which is received by all versions of the present invention in the vicinity (#3); the receivers, upon picking up the signal, trigger warning lights (#4); the drivers of vehicles in the vicinity equipped with the present invention react to the warning lights with heightened awareness and attempt to avoid the danger (all components of the invention are powered by the respective vehicle battery, #5). From an installation standpoint, one will merely make a connection between the vehicle's horn and the transmitter (#1 to #2), and between the receiver and the intended warning lights, if the warning lights are existing vehicle lights and not already inherent to the device (#3 to #4). By tying in the vehicle's battery as a power source for the transmitter and receiver (#5 to #2 and #5 to #3), you will have a successful installation that could be checked for effectiveness with a simple sounding of the vehicle's horn (activation of the horn will result in a flash of the inherent light source or all of the linked dashboard warning lights). Installation will be easier than what is currently required for add-on car alarms that are intended to prevent vehicle theft.

Based on the description just given, it is anticipated that anyone with some degree of electronics background and current theft protection car alarm installation experience could fashion a crude "proof-of-concept" version of the invention with nothing more than a garage door opener transmitter, accompanying receiver logic board assembly, and necessary wire plus electrical connectors.

OPERATION—FIGS. 3 & 4

FIG. 3 depicts a specific field example of the device in-use. As background, one can envision that standard vehicle 6A and standard vehicle 6B are traveling in the same direction on a two-lane freeway. Standard vehicle 6A is in the process of passing standard vehicle 6B and is temporarily located in the "blind spot" of the driver of standard vehicle 6B. Assuming then that the driver of standard vehicle 6B begins a lane change (possibly to pass a vehicle in front of him/her), the most expedient way for the driver of standard vehicle 6A to communicate the impending danger of collision is to activate his/her horn (#1A). If the hearing of the driver of standard vehicle 6B is impaired due to aforementioned influences (e.g., design of vehicle intended to preclude noise from entering passenger compartment, stereo sound system playing, etc.), the potential for collision between the two vehicles is elevated. If, however, the respective vehicles are equipped with the present invention: Activating the horn (#1A) of standard vehicle 6A will also energize its transmitter (#2A); the receiver (#3B) of standard vehicle 6B will pick-up the transmitted signal and will activate a warning light(s) (#4B), and the driver of standard vehicle 6B, so warned, will react with heightened awareness (by probably returning to his/her lane), thereby avoiding a potential collision with standard vehicle 6A. Note that the receiver (#3A) of standard vehicle 6A will also pick-up the signal of the transmitter (#2A), and will result in the warning lights (#4A) being energized for as long as the horn (#1A) is in-use.

It should be readily apparent that the collision preventing potential of the invention, as just described and as described in the next paragraph, will hold true in any instance where a horn or siren (and/or flashing lights) is used in an attempt to warn a nearby driver of impending danger.

FIG. 4 depicts another specific field example of the device in-use. As background, one can envision that standard vehicle 6G is traveling toward an intersection with a "green light" and emergency vehicle 6H is traveling toward the same intersection from the crossing direction, and thus is exposed to a "red light". Assuming that emergency vehicle 6H is responding to a crisis, its intent will be to go through the "red light" and thus cross directly in the path of standard vehicle 6G. With an obstructed view, as depicted, the drivers of the respective vehicles will be unaware of their collision course unless the driver of standard vehicle 6G can hear the siren of the emergency vehicle 6H. With the hearing of the driver of standard vehicle 6G impaired due to aforementioned influences (e.g., design of vehicle intended to preclude noise from entering passenger compartment, stereo sound system playing, etc.), the potential for collision between the two vehicles is elevated. If, however, the respective vehicles are equipped with the present invention: Activating the siren and/or flashing lights (#1H) of emergency vehicle 6H will also energize its transmitter (#2H); the receiver (#3G) of standard vehicle 6G will pick-up the transmitted signal and will activate a warning light(s) (#4G); and the driver of standard vehicle 6G, so warned, will react with heightened awareness and could likely avoid a potential collision with emergency vehicle 6H. Note that the receiver (#3H) of emergency vehicle 6H will also pickup the signal of the transmitter (#2H), and will result in the warning lights (#4H) being energized for as long as the siren and/or flashing lights (1H) are in-use.

CONCLUSION, RAMIFICATIONS AND SCOPE

While my above description contains many specificities, these should not be construed as limitations on the scope of the invention, but rather as an exemplification of one preferred embodiment thereof. Many other variations are possible. For example, and as stated earlier, there are at least five versions of the invention that this application is intended to cover. The retrofit of a standard (non-emergency) vehicle described above. A version for new manufacture of standard (non-emergency) vehicles where installation of the device is at the factory and the warning light is a unique dashboard warning that is of sufficient size and appropriate location to meet the intent of invention. A version for retrofit of emergency vehicles which ties both the horn and siren (and/or emergency flashing lights) into the transmitter. A version for new manufacture of emergency vehicles where the device is installed at the factory (ties both the horn and siren/flashers into the transmitter and employs a unique dashboard warning light). And another potential version, described next, as an example of alternate embodiment.

FIGS. 5A, 5B and 5C collectively depict an alternate embodiment for standard vehicle retrofit (independent of the other figures) that utilizes power sources other than the vehicle's battery in order to make the device more modular in appearance and deployment. FIG. 5A simply shows a vehicle X without the apparatus. FIG. 5B shows that the receiver (#13) and warning light (#14) in vehicle Y could be housed in a single module and be powered by an independent battery (#15A). By doing so, the individual owner/driver of a vehicle has the flexibility to place the warning light wherever he/she prefers (e.g., analogous to radar detectors that can be clipped to a visor, adhesively mounted to the surface of the dashboard, or attached to the windshield via suction cups). In a like fashion, the transmitter (#12) could also be powered by an independent battery (#15B). The "trigger" for activating the transmitter (#12) could be placed immediately over, and in contact with, the existing horn (#11) activation pad(s). An analogy is to a finger activated button (like a doorbell or garage door opener transmitter) on top of another finger activated button; finger pressure on the top button will be transferred to the bottom button, thus engaging both. As the one side view, FIG. 5C, depicts, a contact pad (#12B) could be linked to a power source (#15B) while its twin (#12A) could be linked to the transmitter (#12), both (as the #12A & #12B combination) being adhesively attached to the existing horn (#11) activation pad(s). Pressure on contact pad #12B will bring it to impact contact pad #12A, thus closing the electronic circuit and energizing the transmitter (#12). This same pressure will be transferred to the existing horn (#11) activation pad(s), thus sounding the vehicle's horn. In this fashion, both horn (#11) and transmitter (#12) are energized with the same driver action. It is anticipated that numerous pairs of transmitter contact pads (#12A & #12B) could be provided with the apparatus in order to accommodate different vehicle designs (i.e., some vehicles have one large activation pad for their horn {#11}, whereas others have two or more smaller activation pads). The contact pad pairs (#12A & #12B) would be trimmed to the necessary size to fit over the existing horn (#11) activation pad(s), and could be provided with an adhesive that would facilitate bonding to the same existing horn (#11) activation pad(s).

The transmitter (FIG. 5C, #12) and battery (#15B) could also be housed in the same module and be attached to the steering wheel (#19) so that tangled wire connections with the transmitter contact pad pairs (#12A & #12B) will not result from turning of the steering wheel (#19). The advantage of this embodiment is that it could be installed by the driver/owner, as opposed to requiring the expertise of a vehicle electronics mechanic for installation (to make connections to the vehicle horn, dashboard warning lights, battery, etc.). It should be apparent that any/all of the variations associated with the preferred embodiment, and this alternate, could be mixed/matched as necessary to provide the best device for the consumer (e.g., transmitter powered by the existing vehicle's battery and linked electrically to the existing horn, but the receiver and warning light housed in a distinct module and powered by an independent battery).

Although the preferred transmitter/receiver described is analogous to garage door opener technology (due to simplicity, cost, reliability, experience and range of signal), it is obvious that any alternate technology could be utilized. Examples include basically any existing means for remote control/communication - infrared, radar, any radio frequency, T.V., microwave, etc.

It is also apparent that the visual warning could take numerous forms in the vehicle's passenger compartment. Although the existing dashboard warning lights seem logical from a retrofit standpoint because they are designed/located (line of sight) to attract the driver's immediate attention, any other visual means of alarming the driver could be utilized. The device could have its own light inherent to the apparatus or could be tied to a light that is situated on top of the dashboard, or to other existing lights, such as dome lights, map lights, turn signals, etc. The device could also be tied to the new "heads-up" display technology such that the warning will simply appear in the driver's direct line of sight.

From the emergency vehicle standpoint, you could tie the device exclusively to the horn and siren, or to the horn, siren and flashing lights (so the transmitter will also signal whenever the flashing lights are activated without siren or horn). One could also alter the range of transmitted signals such that those emanating from emergency vehicles will carry farther than those from standard vehicles.

Extensions of the invention's utility could include applications for boating, trains or even stationary traffic hazards (e.g., a transmitter could be stationed at railroad crossings that do not employ gates or other signaling means and could be "tripped" by an approaching train, or at construction sights to augment the use of signs, or basically anywhere that heightened driver awareness could be advantageous).

The invention could also utilize a speaker to produce an amplified warning sound within the passenger compartment, in addition to the warning lights, thus augmenting the visual stimulus with an audible warning that could be heard by the driver. And the device could also be equipped with an "off" switch, if the warning lights were considered a nuisance in big city traffic where they could be flashing at a near constant pace.

Accordingly, the scope of the invention should be determined not by the embodiment(s) illustrated, but by the appended claims and their legal equivalents.

I claim:

1. A method for a driver of a first vehicle to visually warn a driver of a second vehicle of impending danger, and for said driver of said first vehicle to receive a visual confirmation in said first vehicle of successful warning transmission, comprising the steps of:

a. activating a horn in said first vehicle, b. transmitting a predetermined signal in response to the activation of said horn in said first vehicle, c. receiving said predetermined signal in both said first vehicle and said second vehicle, d. activating a warning light in both said first vehicle and said second vehicle, in response to the receipt of said predetermined signal in both said first vehicle and said second vehicle, whereby said first driver gets said visual confirmation in said first vehicle of successful warning transmission, and said second driver is visually warned by said first driver of the impending danger.

2. The method of claim 1 wherein said predetermined signal is a radio signal.

3. The method of claim 1 wherein said predetermined signal carries less than approximately 150 meters.

4. The method of claim 1 wherein said warning light is one or more dashboard warning lights located in said vehicle.

5. The method of claim 1 wherein said warning light is augmented by an audible sound.

6. The method of claim 1 wherein said first vehicle is equipped with a siren and, or, flashing lights.

7. The method of claim 6 wherein transmitting said predetermined signal is in response to the activation of said horn, and, or, said siren and, or, said flashing lights of said first vehicle.

8. The method of claim 7 wherein said predetermined signal is a radio signal.

9. The method of claim 7 wherein said predetermined signal carries less than approximately 400 meters.

10. The method of claim 7 wherein said warning light is augmented by an audible sound.

11. A visual alarm system for a driver of a first vehicle to visually warn a driver of a second vehicle of impending danger, comprising:

a. a transceiver of a predetermined signal, and means for said transceiver to be triggered upon activation of a horn in said first vehicle, b. means for said transceiver in said first vehicle to activate a warning light in said first vehicle upon receipt of said predetermined signal, wherein said first driver gets visual confirmation in said first vehicle of successful warning transmission, and c. a transceiver of said predetermined signal in said second vehicle, and means for said transceiver in said second vehicle to activate a warning light in said second vehicle upon receipt of said predetermined signal, wherein said second driver is visually warned by said first driver of the impending danger.

12. The device of claim 11 wherein said predetermined signal is a radio signal.

13. The device of claim 11 wherein said predetermined signal carries less than approximately 150 meters.

14. The device of claim 11 wherein said warning light is one or more dashboard warning lights located in said vehicle.

15. The device of claim 11 wherein said warning light is augmented by an audible sound.

16. The device of claim 11 wherein said first vehicle is equipped with a siren and, or, flashing lights.

17. The device of claim 16 wherein means for said first vehicle transceiver to be triggered are upon activation of said horn, and, or, said siren and, or, said flashing lights of said first vehicle.

18. The device of claim 17 wherein said predetermined signal is a radio signal.

19. The device of claim 17 wherein said predetermined signal carries less than approximately 400 meters.

20. The device of claim 17 wherein said warning light is augmented by an audible sound.

* * * * *